US009784233B2

(12) United States Patent
Obe

(10) Patent No.: US 9,784,233 B2
(45) Date of Patent: Oct. 10, 2017

(54) IGNITER AND VEHICLE

(71) Applicant: Rohm Co., Ltd., Kyoto (JP)

(72) Inventor: Katsuya Obe, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 161 days.

(21) Appl. No.: 14/923,512

(22) Filed: Oct. 27, 2015

(65) Prior Publication Data

US 2016/0123294 A1 May 5, 2016

(30) Foreign Application Priority Data

Oct. 31, 2014 (JP) ..... 2014-223098

(51) Int. Cl.
*F02P 17/12* (2006.01)
*F02P 3/04* (2006.01)
*F02D 35/02* (2006.01)

(52) U.S. Cl.
CPC ..... *F02P 17/12* (2013.01); *F02P 3/0442* (2013.01); *F02D 35/028* (2013.01); *F02P 2017/121* (2013.01)

(58) Field of Classification Search
CPC .... F02P 17/12; F02P 3/0442; F02P 2017/121; F02D 35/028
USPC ..... 123/623
See application file for complete search history.

(56) References Cited

U.S. PATENT DOCUMENTS 4,607,602 A * 8/1986 Komurasaki ..... F02P 5/1455 123/406.35
9,350,142 B2 * 5/2016 Obe ..... H01T 15/00
9,587,616 B2 * 3/2017 Minoya ..... F02P 5/15

FOREIGN PATENT DOCUMENTS

JP 2011-185165 9/2011
JP 2013-124603 6/2013
JP 2014-051904 3/2014

* cited by examiner

*Primary Examiner* — Mahmoud Gimie
(74) *Attorney, Agent, or Firm* — Fish & Richardson P.C.

(57) ABSTRACT

An igniter includes: a switch connected to an ignition coil; and a controller to control the switch according to an ignition signal. The controller includes an ignition signal input; a determination stage comparing a voltage of the input with a reference voltage to generate a determination signal; a drive stage controlling the switch's ON/OFF according to the determination signal; a comparison circuit receiving a first supply voltage, comparing a current on the switch with a reference current, and generating a feedback-signal having a level based on the comparison; an output transistor having one end grounded and the other end connected to an output terminal of an ignition check signal and having a threshold voltage higher than the first supply voltage; and a level-shifter receiving a second supply voltage higher than the threshold voltage, level-shifting the feedback-signal, and outputting the level-shifted feedback-signal to a control terminal of the output transistor.

11 Claims, 9 Drawing Sheets

100

IGNITER AND VEHICLE

CROSS-REFERENCE TO RELATED APPLICATION

This application is based upon and claims the benefit of priority from Japan Patent Application No. 2014-223098, filed on Oct. 31, 2014, the entire contents of which are incorporated herein by reference.

TECHNICAL FIELD

The present disclosure relates to an igniter for controlling an ignition coil connected with an ignition plug of an engine.

BACKGROUND

FIG. 1 is a perspective view of an engine room 101 of a gasoline engine-driven vehicle (hereinafter, simply referred to as a vehicle) 100. The engine room 101 accommodates an engine 110, an intake manifold 112, an air cleaner 113, a radiator 114, a battery 102 and so on. FIG. 1 shows a 4-cylinder engine.

Each cylinder of the engine 110 is provided with a plug hole (not shown) in which an ignition plug is inserted. A mixture of air, which is introduced through the air cleaner 113 and the intake manifold 112, and a fuel from a fuel tank (not shown) is supplied into each cylinder of the engine 110. If the ignition plug is ignited (sparked) at an appropriated timing, the engine is started and rotated.

FIG. 2 is a block diagram of a portion of an electric system of a vehicle 100*r*. The electric system of the vehicle 100*r* includes a battery 102, an ignition coil 104, an ignition plug 106, an ECU 108 and an igniter 200*r*. The ECU 108 periodically generates an ignition signal IGT (Ignition Timing) indicating an ignition timing of the ignition plug 106 in synchronization with the rotation of the engine 110. A secondary coil L2 of the ignition coil 104 is connected to the ignition plug 106. The igniter 200*r* controls a current of a primary coil L1 of the ignition coil 104 in response to the ignition signal IGT. Accordingly, a high voltage (secondary voltage $V_S$) of tens of kV can be generated in the secondary coil L2 to discharge the ignition plug 106 so that the mixture in the engine 110 is exploded.

The igniter 200*r* includes a switch device 202 and a switch controller 300*r*. The switch device 202 may be an IGBT (Insulated Gate Bipolar Transistor) having a collector connected to the primary coil L1 and an emitter grounded. In response to the ignition signal IGT, the switch controller 300*r* controls a voltage of a control terminal (gate) of the switch device 202 to control ON/OFF of the switch device 202. Specifically, the switch controller 300*r* puts the switch device 202 under an ON state in a period for which the ignition signal IGT has a high level. When the switch device 202 is turned on, a battery voltage $V_{BAT}$ is applied across the primary coil L1 and the current flowing through the primary coil L1 increases according to time passage. When the ignition signal IGT transitions to a low level, the switch controller 300*r* turns off the switch device 202 instantly to cut off the current $I_{L1}$ of the primary coil L1. At this time, a primary voltage $V_{L1}$ of hundreds of V ($=L \cdot dI_{L1}/dt$) that is proportional to the time derivative of the current $I_{L1}$ is generated in the primary coil L1. At this time, the secondary voltage $V_S$ of tens of kV, which is a product of the primary voltage VL1 and a winding ratio, is generated in the secondary coil L2.

The switch controller 300*r* includes a front determination stage 300A and a rear drive stage 300B. The determination stage 300A receives the ignition signal IGT from the ECU 108 and determines its level (High/Low). Here, the igniter 200*r* used in the engine room is exposed to a variety of surge noises and high frequency noises. In order to prevent the igniter 200*r* from malfunctioning due to the high frequency noises, a high frequency filter 303 to eliminate the high frequency noises superimposed on the ignition signal IGT is provided in the determination stage 300A. A determination comparator 302 compares a voltage level $V_{FIL}$ of the ignition signal IGT passed through the high frequency filter 303 with a predetermined reference voltage (threshold value) $V_{REF}$ to generate a bi-leveled (High/Low) determination signal $S_{DET}$ based on a result of the comparison.

The drive stage 300B switches ON/OFF of the switch device 202 in response to the determination signal $S_{DET}$. A delay circuit 304 gives a predetermined delay to the determination signal $S_{DET}$. An amount of the delay is set such that a time lag (delay) between the transition of the ignition signal IGT and the discharging of the ignition plug becomes a predetermined value. A pre-driver 306 and a gate driver 308 control the gate voltage of the switch device 202 in response to an output of the delay circuit 304.

An ignition circuit (hereinafter referred to as an IGF (Ignition Feedback) circuit) 340*r* monitors a coil current $I_C$ flowing through the switch device 202 and informs the ECU 108 of an IGF signal indicating a result of the monitoring. Specifically, two reference currents $I_{THL}$ and $I_{THH}$ are defined in the IGF circuit 340*r*. If $I_C<I_{THL}$ or $I_{THH}<I_C$, the IGF signal has a first level (e.g., high level). If $I_{THL}<I_C<I_{THH}$, the IGF signal has a second level (e.g., low level).

FIG. 3 shows a circuit diagram of the IGF circuit 340*r* examined by the present inventor. The IGF circuit 340*r* includes comparators CMP1 and CMP2, a logic gate 342 and an output transistor 344. A resistor $R_{CS}$ for current detection is interposed between the emitter of the switch device 202 and ground. A voltage drop (detection voltage $V_{CS}$) that is proportional to the coil current $I_C$ is generated in the resistor $R_{CS}$.

The comparator CMP1 compares the detection voltage $V_{CS}$ with a reference voltage $V_{THH}$ corresponding to the first reference current $I_{THH}$ and outputs a comparison signal S11 having a high level when $V_{THH}<V_{CS}$. The comparator CMP2 compares the detection voltage $V_{CS}$ with a reference voltage $V_{THL}$ corresponding to the second reference current $I_{THL}$ and outputs a comparison signal S12 having a high level when $V_{THL}<V_{CS}$. The logic gate 342 performs a logic operation for the two comparison signals S11 and S12 to output a feedback signal S13. For example, the logic gate 342 produces a logical product of the comparison signal S12 and an inversion of the comparison signal S11.

The output transistor 344 of the IGF circuit 340*r* is of an open drain (open collector) type. The output transistor 344 has a drain connected to an IGF terminal, a source connected to a ground line 312, and a gate to which the output S13 of the logic gate 342 is input. The IGF terminal and the ECU 108 are interconnected via a harness 116. A signal line 118 of the harness 116 that transmits the IGF signal is pulled-up in the ECU 108. The ECU 108 detects whether or not the igniter 200*r* is normally operating, based on a voltage waveform (edge timing or pulse width) Vx of the signal line 118.

As a result of the examination on the igniter 200*r* of FIG. 3, the present inventor came to recognize the following problems.

Here, the igniter 200*r* used in the engine room is exposed to a variety of surges and noises (hereinafter, collectively referred to as noises). Therefore, the igniter 200*r* is increasingly required to have resistance to various noises.

FIG. 4 is an operation waveform diagram of the igniter 200*r* of FIG. 3. It is noted that vertical and horizontal axes of waveform diagrams or time charts referred to in the present disclosure are appropriately enlarged or reduced for ease of understandings. Further, the waveforms shown are simplified, exaggerated or emphasized for ease of understanding. If a surge or noise S20 is introduced in the igniter 200*r*, the detection voltage $V_{CS}$, a potential $V_{GND}$ of the ground line 312 or a power supply voltage $V_{DD}$ may be varied. Thus, chattering occurs on the comparison signals S11 and S12 to propagate to the feedback signal S13. As a result, the IGF signal is varied.

In addition, due to a noise S21, timings of change in levels of the comparison signals S11 and S12 may be shifted, which may result in deviation in timings of the feedback signal S13 and further the IGF signal.

The variation (chattering) of the feedback signal S13 due to the chattering of the comparison signals S11 and S12 may be managed in some degrees by setting a hysteresis in the comparators CMP1 and CMP2.

On the other hand, the ground voltage $V_{GND}$ may be swung due to a noise introduced in the ground line 312. In addition, if a noise is introduced in the gate of the output transistor 344, even when the comparison signals S11 and S12 are operated normally, due to the noise, the output transistor 344 may be switched to cause the IGF signal to swing.

SUMMARY

The present disclosure provides some embodiments of an igniter being capable of improving noise resistance of an IGF signal.

According to one embodiment of the present disclosure, there is provided an igniter including, a switch device connected to a primary coil of an ignition coil; and a switch controller configured to control the switch device in response to an ignition signal from an ECU (Engine Control Unit). The switch controller includes an input line to which the ignition signal is input; a determination stage in which a voltage of the input line is compared with a predetermined reference voltage to generate a determination signal based on a result of the comparison; a drive stage in which ON/OFF of the switch device is controlled in response to the determination signal; a current comparison circuit, the current comparison circuit receiving a first power supply voltage, comparing a coil current flowing through the switch device with at least one reference current, and generating a feedback signal having a logical level based on a result of the comparison; an output transistor having one end grounded and the other end connected to a terminal for outputting an ignition check signal, the output transistor having a threshold voltage higher than the first power supply voltage; and a level shifter to receive a second power supply voltage higher than the threshold voltage of the output transistor, to level-shift the feedback signal, and to output the level-shifted feedback signal to a control terminal of the output transistor.

In this embodiment, a logic circuit included in the current comparison circuit is constituted with a transistor that is operable with the first power supply voltage, i.e., having a threshold voltage lower than the first power supply voltage. Thus, power consumption of the current comparison circuit can be reduced. In addition, by constituting the output transistor with a transistor having a threshold voltage higher than the second power supply voltage, even when a voltage of the control terminal of the output transistor is varied due to surges or noises, it is possible to prevent the output transistor from being turned on/off due to the surges or noises, thereby increasing the noise resistance of the IGF signal.

The level shifter may include a first resistor and a first transistor that are connected in series between a ground line and a second power supply line to which the second power supply voltage is supplied.

The current comparison circuit may compare the coil current with an upper reference current and a lower reference current. The feedback signal may have (i) a first level when the coil current is smaller than the lower reference current or larger than the upper reference current and (ii) a second level when the coil current is larger than the lower reference current and smaller than the upper reference current.

The current comparison circuit may include at least one voltage comparator which compares a detection voltage proportional to the coil current with at least one reference voltage corresponding to the at least one reference current.

The current comparison circuit may include a filter circuit to eliminate noises of the detection voltage. With this configuration, it is possible to eliminate noises superimposed on the detection voltage and increase the noise resistance.

The at least one reference voltage may have a hysteresis. With this configuration, it is possible to prevent the comparison signal from chattering even when noises are superimposed on the detection voltage.

The at least one voltage comparator may include: a second transistor; a second resistor connected between a ground line and an emitter of the second transistor; a third transistor having a base connected to a base of the second transistor and an emitter to which the detection voltage is input; a first current source connected to a collector of the second transistor; a second current source connected to a collector of the third transistor; a fourth transistor having a base connected to the collector of the second transistor and an emitter connected to the bases of the second transistor and the third transistor; a third resistor and a fourth resistor that are connected in series between the emitter of the second transistor and the bases of the second transistor and the third transistor; and a fifth transistor interposed between the ground line and a node between the third resistor and the fourth resistor and having a base to which an output signal of the voltage comparator is input.

If a voltage level of the detection voltage is small, it may be difficult to use a voltage comparator using a differential amplifier (or operational amplifier). With this configuration, it is possible to make the voltage comparison without using a differential amplifier and to set a hysteresis in the reference voltage.

The igniter may further include a current sense resistor interposed between the switch device and the ground. A voltage across the current sense resistor may be the detection voltage.

The current comparison circuit may include: a first comparator to compare a detection voltage corresponding to the coil current with an upper reference voltage corresponding to the upper reference current and output a first comparison signal based on a result of the comparison; a second comparator to compare the detection voltage with a lower reference voltage corresponding to the lower reference current and output a second comparison signal based on a result of the comparison; and a logic circuit to perform a logical operation for the first comparison signal and the second comparison signal to generate the feedback signal.

The switch controller may be integrated on a single semiconductor substrate.

As used herein, the term "integrated" is intended to include both of a case where all elements of a circuit are formed on a semiconductor substrate and a case where main elements of the circuit are integrated on the semiconductor substrate. In addition, some resistors, capacitors and the like for adjustment of a circuit constant may be provided outside the semiconductor substrate.

According to another embodiment of the present disclosure, a gasoline engine; an ignition plug; an ignition coil having a primary coil and a secondary coil connected to the ignition plug; an ECU to generate an ignition signal indicating ignition of the ignition plug; and the above-described igniter, the igniter driving the ignition coil in response to the ignition signal.

Any combinations of the above-described elements or changes of the representations of the present disclosure between methods, apparatuses and systems are effective as embodiments of the present disclosure.

DETAILED DESCRIPTION

Figure 1:
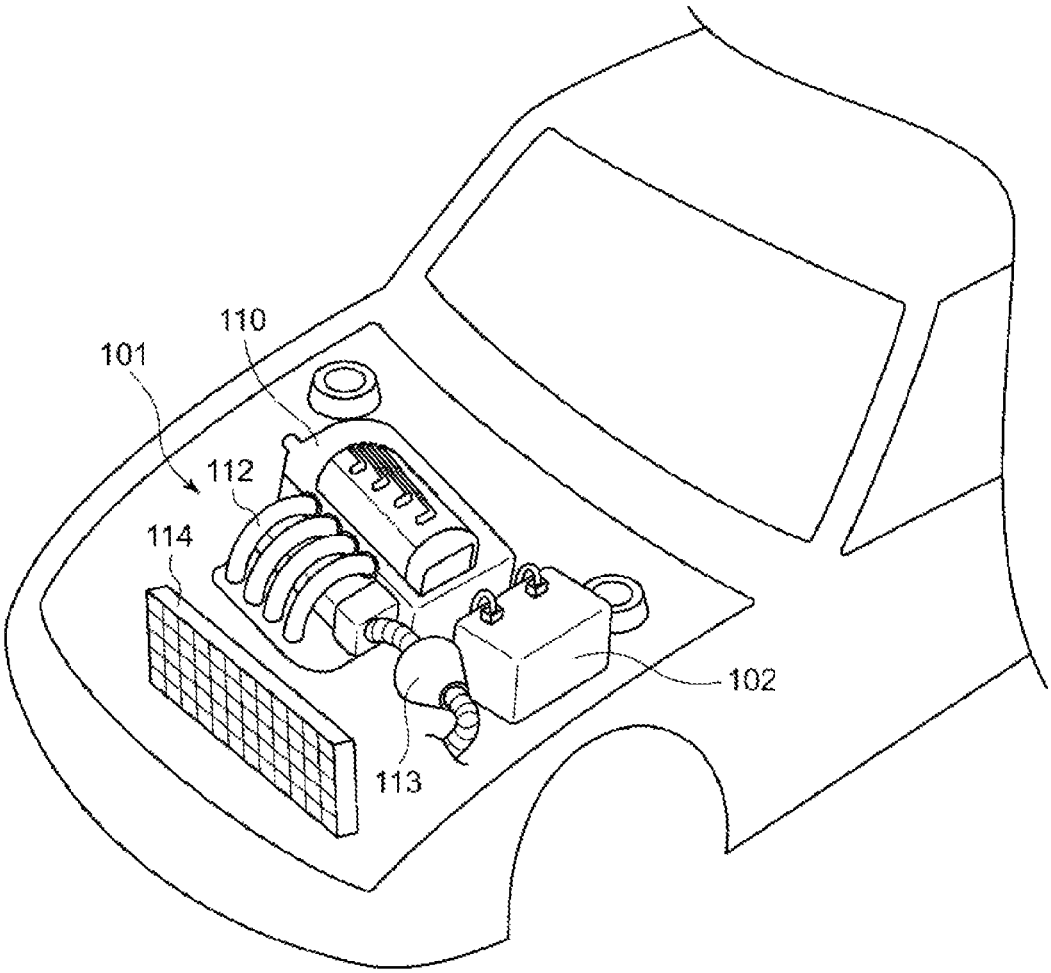
FIG. 1 (PRIOR ART)
FIG. 1 is a perspective view of an engine room of a gasoline engine-driven vehicle.

Embodiments of the present disclosure will now be described in detail with reference to the drawings. Throughout the drawings, the same or similar elements, members and processes are denoted by the same reference numerals and explanation of which will not be repeated. The disclosed embodiments are provided for the purpose of illustration, not limitation, of the present disclosure and all features and combinations thereof described in the embodiments cannot be necessarily construed to describe the spirit of the present disclosure.

In the specification, the phrase "connection of a member A and a member B" is intended to include direct physical connection of the member A and the member B as well as indirect connection thereof via other member as long as the other member has no substantial effect on the electrical connection of the member A and the member B.

Similarly, the phrase "interposition of a member C between a member A and a member B" is intended to include direct connection of the member A and the member C or direct connection of the member B and the member C as well as indirect connection thereof via another member as long as the other member has no substantial effect on the electrical connection of the member A, the member B and the member C.

Figure 2:
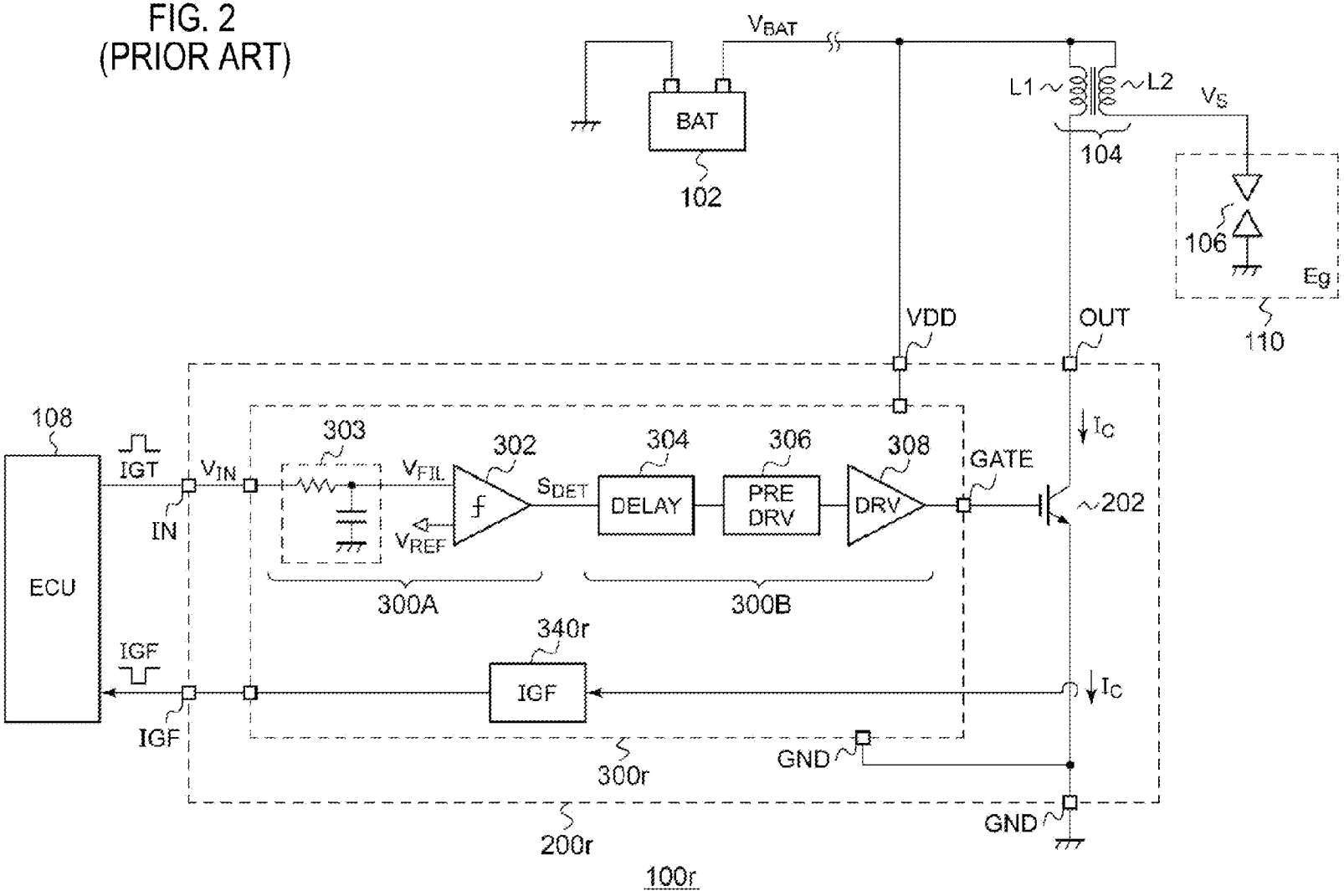
FIG. 2 (PRIOR ART)
FIG. 2 is a block diagram of a portion of an electric system of a vehicle.
Figure 5:
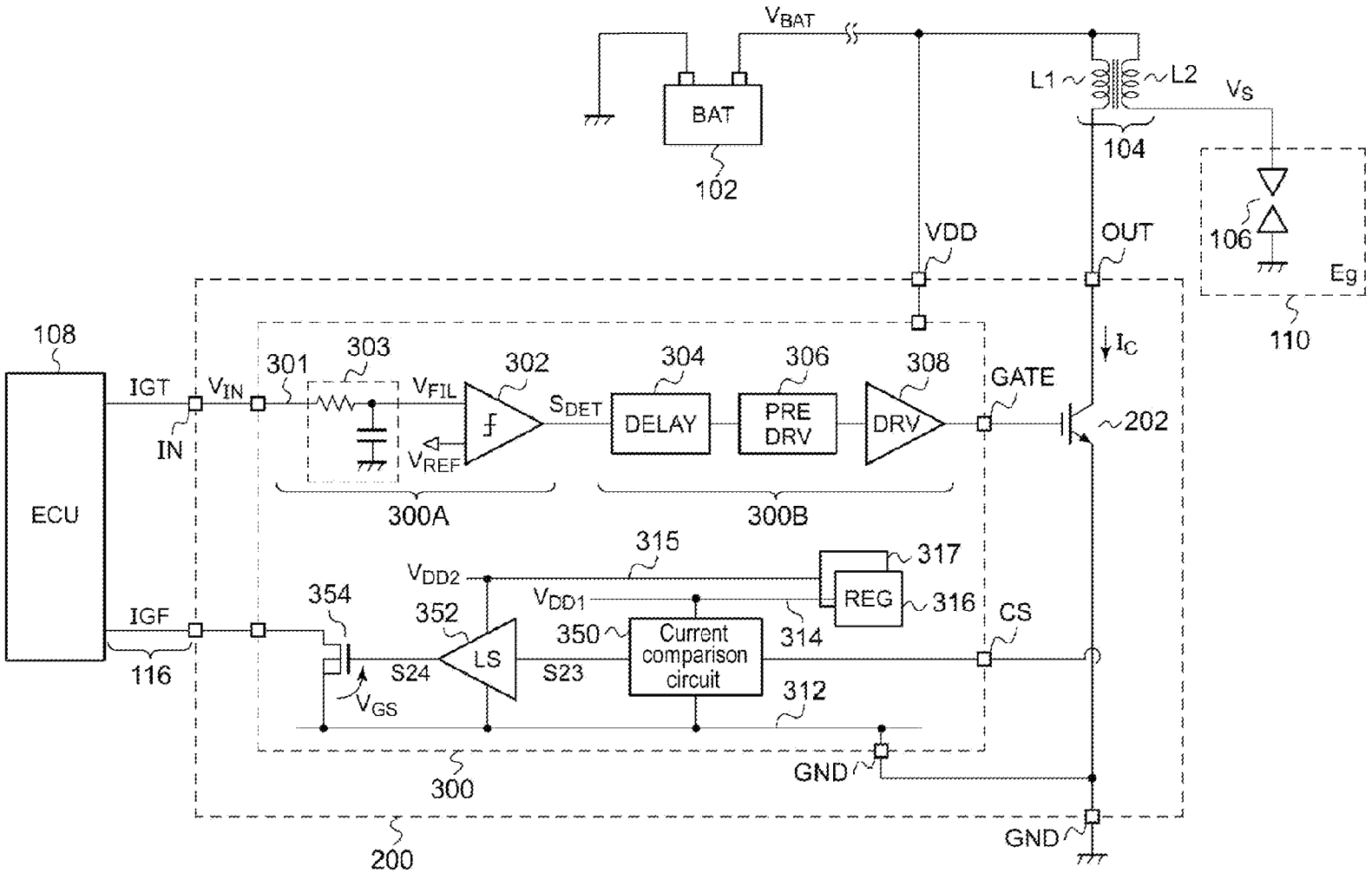
FIG. 5 is a circuit diagram of an igniter according to an embodiment.

FIG. 5 is a circuit diagram of an igniter 200 according to an embodiment. The igniter 200 includes a switch device 202 and a switch controller 300. The switch controller 300 is a functional IC that includes a determination stage 300A, a drive stage 300B, a current comparison circuit 350, a level shifter 352 and an output transistor 354 and is integrated on a single semiconductor substrate. The determination stage 300A and the drive stage 300B have basically the same configuration as those shown in FIG. 2.

The determination stage 300A includes a high frequency filter 303 and a determination comparator 302. An ignition signal IGT is input from an ECU 108 to an input line 301. The high frequency filter 303 eliminates high frequency noises of the input line 301.

The determination comparator 302 compares an output voltage $V_{FIL}$ of the high frequency filter 303 with a reference voltage $V_{REF}$ to generate a determination signal $S_{DET}$. In this embodiment, a state of $V_{FIL}>V_{REF}$ ($V_{IN}>V_{REF}$) corresponds to an ON state of the switch device 202, whereas a state of $V_{FIL}<V_{REF}$ ($V_{IN}<V_{REF}$) corresponds to an OFF state of the switch device 202. In addition, the determination signal $S_{DET}$ has a high level (i.e., is asserted) when $V_{FIL}>V_{REF}$ and a low level (i.e., is negated) when $V_{FIL}<V_{REF}$. Therefore, the high level of determination signal $S_{DET}$ is an assert level corresponding to the ON state of the switch device 202 and the low level of determination signal $S_{DET}$ is a negate level corresponding to the OFF state of the switch device 202. The assignment of high and low levels and assert and negate levels is a matter of design and may be interchanged.

The drive stage 300B controls ON/OFF of the switch device 202 in response to the determination signal $S_{DET}$ generated by the determination stage 300A. The drive stage 300B includes a delay circuit 304, a pre-driver 306 and a gate driver 308. The delay circuit 304 gives a predetermined delay Td1 to the determination signal $S_{DET}$. This delay amount Td1 is set such that a time lag (delay) between the transition of the ignition signal IGT and the discharging of the ignition plug becomes a predetermined value. The pre-driver 306 and the gate driver 308 control a control terminal (gate) voltage $V_G$ of the switch device 202 in response to an output S2 of the delay circuit 304.

The switch controller 300 further includes the current comparison circuit 350, the level shifter 352 and the output transistor 354. The igniter 200 is provided with first and second power supply voltages $V_{DD1}$ and $V_{DD2}$ having different levels. These power supply voltages $V_{DD1}$ and $V_{DD2}$ are respectively generated by internal regulators 316 and 317 contained in the igniter 200. The power supply voltages $V_{DD1}$ and $V_{DD2}$ may be supplied from an external power supply.

The current comparison circuit 350 receives the first power supply voltage $V_{DD1}$ as an operation voltage (power supply voltage). The current comparison circuit 350 compares a coil current IC flowing through the switch device 202 with at least one reference current $I_{TH}$ to generate a feedback signal S23 having a logic level based on a result of the comparison. The feedback signal S23 output from the current comparison circuit 350 sets the ground voltage ($V_{GND}$=0V) and the first power supply voltage $V_{DD1}$ to a low level and a high level, respectively.

Figure 3:
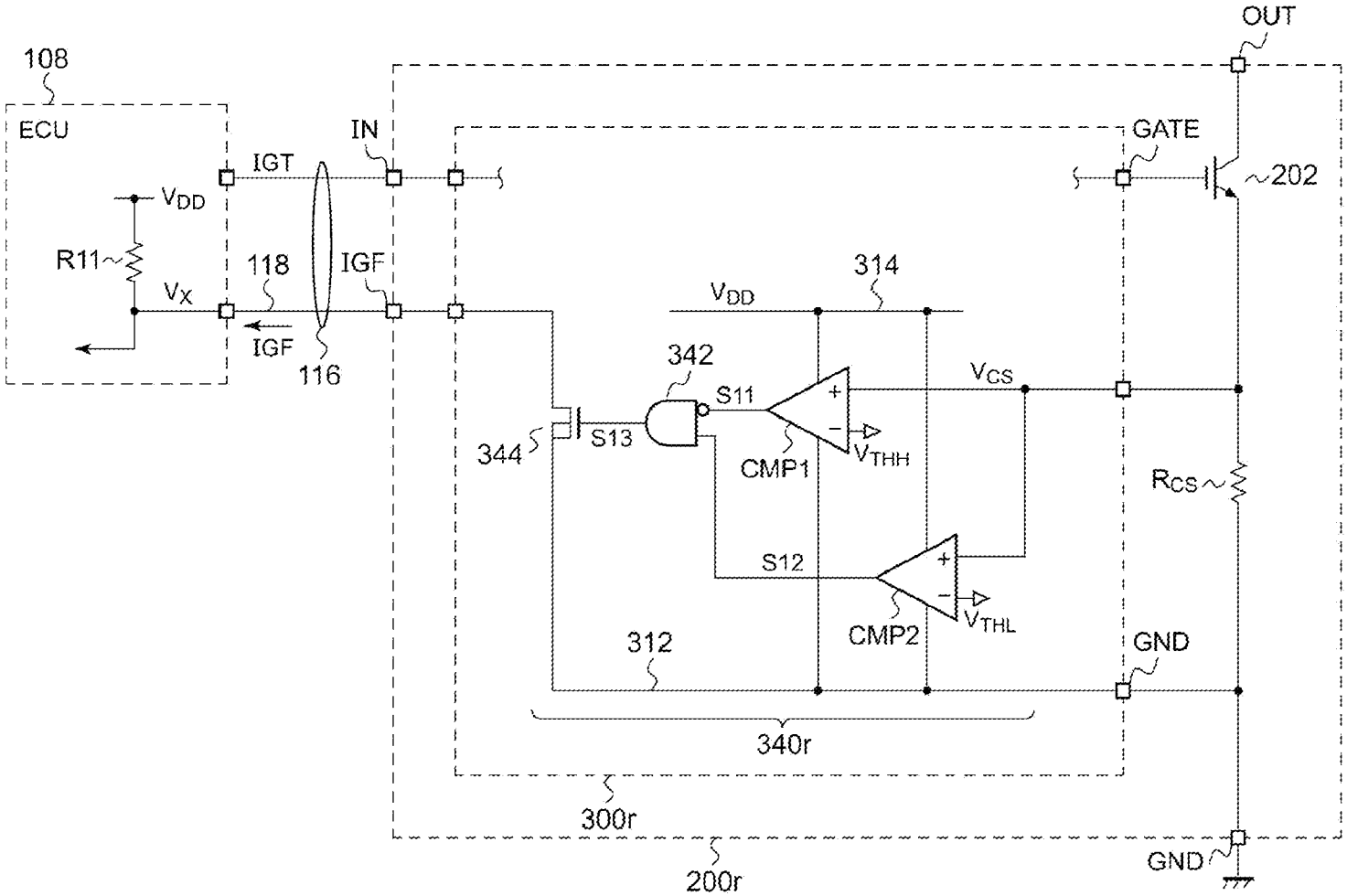
FIG. 3 (PRIOR ART)
FIG. 3 is a circuit diagram of an IGF circuit examined by the present inventor.
Figure 4:
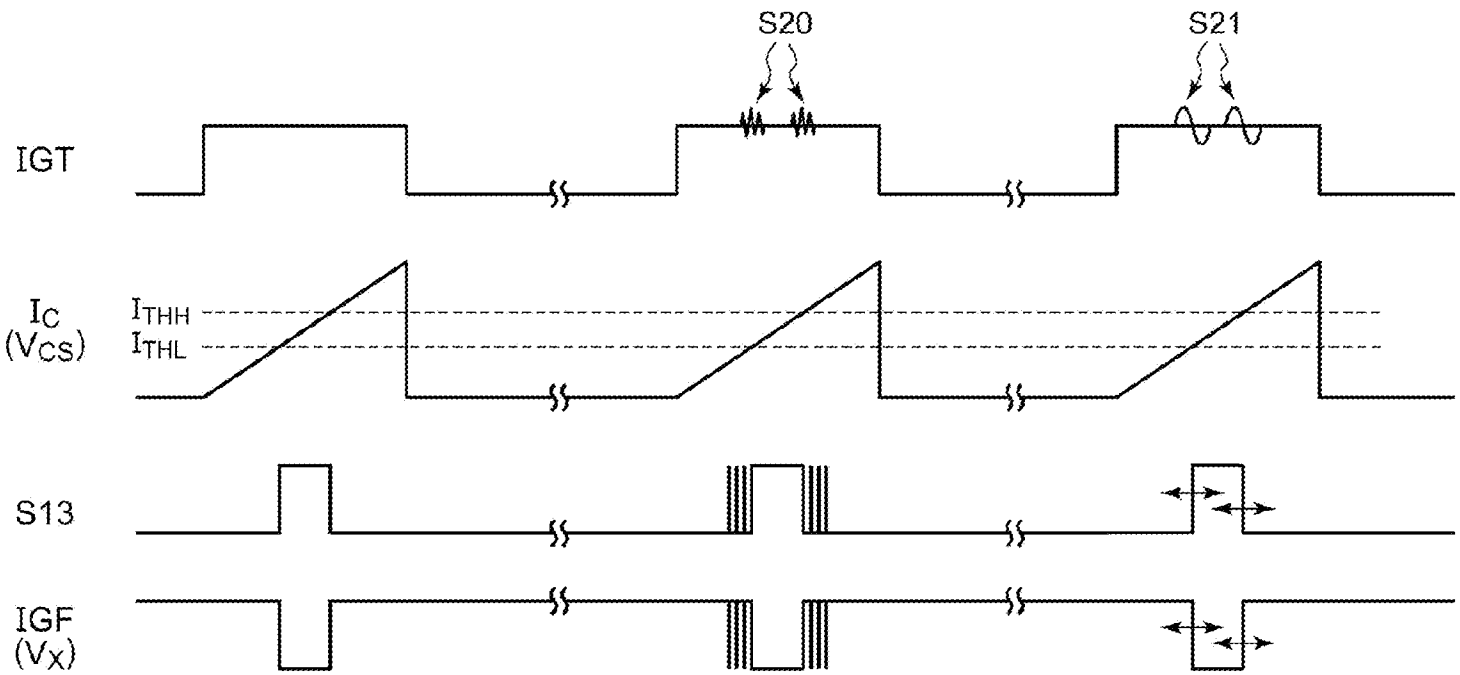
FIG. 4 (PRIOR ART)
FIG. 4 is an operation waveform diagram of the igniter of FIG. 3.

For example, similarly to the IGF circuit 340*r* of FIG. 3, two reference currents $I_{THH}$ and $I_{THL}$ are defined in the current comparison circuit 350. If $I_{THL}<I_C<I_{THH}$, the current comparison circuit 350 generates the feedback signal S23 having a first level (here, high level). If $I_C<I_{THL}$ or $I_{THH}<I_C$, the current comparison circuit 350 generates the feedback signal S23 having a second level (here, low level).

The output transistor 354 is an N channel MOSFET having one end (source) grounded and the other end (drain) connected to an IGF terminal for outputting an ignition check (IGF) signal. A gate-source threshold voltage $V_{GS(TH)}$ of the output transistor 354 is higher than the first power supply voltage $V_{DD1}$. That is, even when the feedback signal S23 setting the first power supply voltage $V_{DD1}$ to the high level is directly input to the gate of the output transistor 354, the output transistor 354 cannot be turned on.

Therefore, the level shifter 352 is interposed between the current comparison circuit 350 and the output transistor 354. The second power supply voltage $V_{DD2}$, which is higher than the first power supply voltage $V_{DD1}$ as a power supply voltage, is supplied to the level shifter 352. The second power supply voltage $V_{DD2}$ is higher than the threshold voltage $V_{GS(TH)}$ of the output transistor 354. For example, $V_{GS(TH)}$ is 5V and $V_{DD2}$ is 7V. The level shifter 352 may level-shift the feedback signal S23 and may logically invert the feedback signal S23 as necessary. Specifically, the level shifter 352 performs a level-shifting so that a high level voltage of an output S24 thereof becomes the voltage level $V_{DD2}$ higher than the threshold voltage $V_{GS(TH)}$ of the output transistor 354 to output to the control terminal (gate) of the output transistor 354.

Figure 6B:
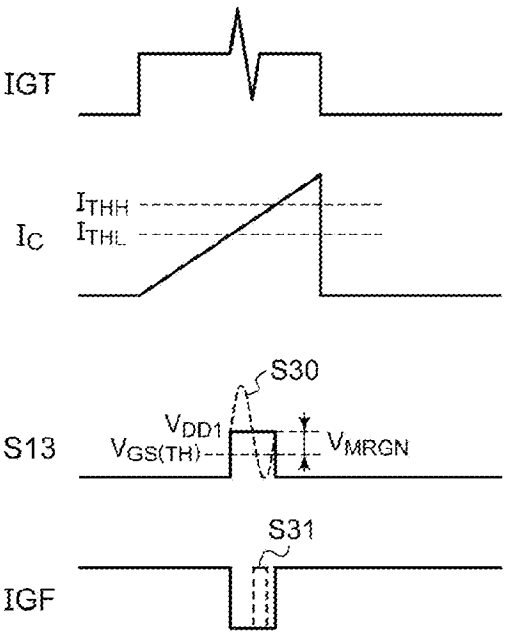
FIG. 6B (PRIOR ART)
FIGS. 6A and 6B are operation waveform diagrams of the igniters of FIGS. 5 and 3, respectively.
Figure 6A:
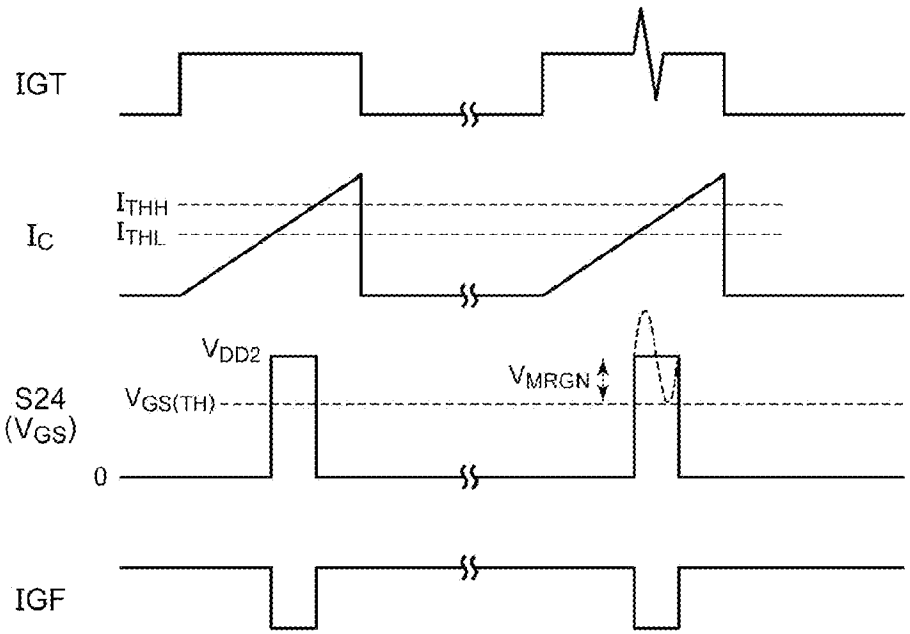

The basic configuration of the igniter 200 has been described above. Subsequently, the operations thereof will be described. FIGS. 6A and 6B are operation waveform diagrams of the igniters 200 and 200*r* of FIGS. 5 and 3, respectively.

To clarify the advantages of the igniter 200 according to the present embodiment, the operation of the igniter 200*r* of FIG. 3 will first be described with reference to FIG. 6B.

An explanation is focused on a section in which the output S13 of the logic gate 342 has a high level. The gate-source voltage $V_{GS}$ of the output transistor 344 is the power supply voltage $V_{DD}$, which may be, for example, 3V.

If noise is introduced in the harness 116, it propagates to the ground line 312 or the power supply line 314 via the IGT terminal and the IGF line so that the ground voltage $V_{GND}$ and the power supply voltage $V_{DD}$ are swung accordingly. When the ground voltage $V_{GND}$ and the power supply voltage $V_{DD}$ are varied due to the noise, the gate-source voltage $V_{GS}$ of the output transistor 344 is also varied.

In order to maintain the ON state of the output transistor 344, the condition of $V_{GS}>V_{GS(TH)}$ must be satisfied and an acceptable noise voltage amplitude $V_{MRGN}$ must be $V_{DD}-V_{GS(TH)}$. When $V_{GS(TH)}$ is 2.5V, $V_{MRGN}$ is 0.5V. If a noise S30 exceeding $V_{MRGN}$ is input between the gate and source of the output transistor 344, a noise S31 appears on the IGF signal.

Subsequently, the operation of the igniter 200 of FIG. 5 will be described with reference to FIG. 6A. An explanation is focused on a section in which an output S24 of the level shifter 352 has a high level. The gate-source voltage $V_{GS}$ of the output transistor 354 is the power supply voltage $V_{DD2}$ (=7V) and the threshold voltage $V_{GS(TH)}$ of the output transistor 354 is 5V. An acceptable noise voltage amplitude $V_{MRGN}$ to maintain the ON state of the output transistor 354 is 2V ($=V_{DD2}-V_{GS(TH)}$. That is, the igniter 200 of FIG. 5 has noise resistance even higher than that of the igniter 200*r* of FIG. 3. Therefore, even when the noise S30 occurs in the gate-source voltage $V_{GS}$, the ON state of the output transistor 354 is maintained and no noise appears on the IGF signal.

Examples of intrusion routes of noises to cause the malfunction of the output transistor 354 may include (i) a route leading from the IGF terminal, through gate-drain capacitance (feedback capacitance Crss), to the gate, and (ii) a route leading from the IGF terminal, through drain-source capacitance (output capacitance Coss), to the ground line 312. The igniter 200 according to the present embodiment can have increased resistance to noise introduced from these routes.

Meanwhile, only to increase the noise resistance, an approach to operate all the circuit elements of the switch controller 300 at a high power supply voltage may be considered. However, this approach causes an increase in power consumption of the switch controller 300, which is contrary to energy saving demands. The igniter 200 according to the present embodiment can suppress the increase in power consumption by constituting only the output transistor 354 connected to the IGF terminal with a high threshold value MOSFET, constituting its previous stage with a low threshold value MOSFET, and operating the current comparison circuit 350 at the low power supply voltage $V_{DD1}$.

The present disclosure is intended to cover various circuits understood from the block diagram or circuit diagram of FIG. 5 or derived from the above description, without being limited to particular circuit configurations. However, for exemplary purposes, detailed configuration examples thereof will be described below.

Figure 7:
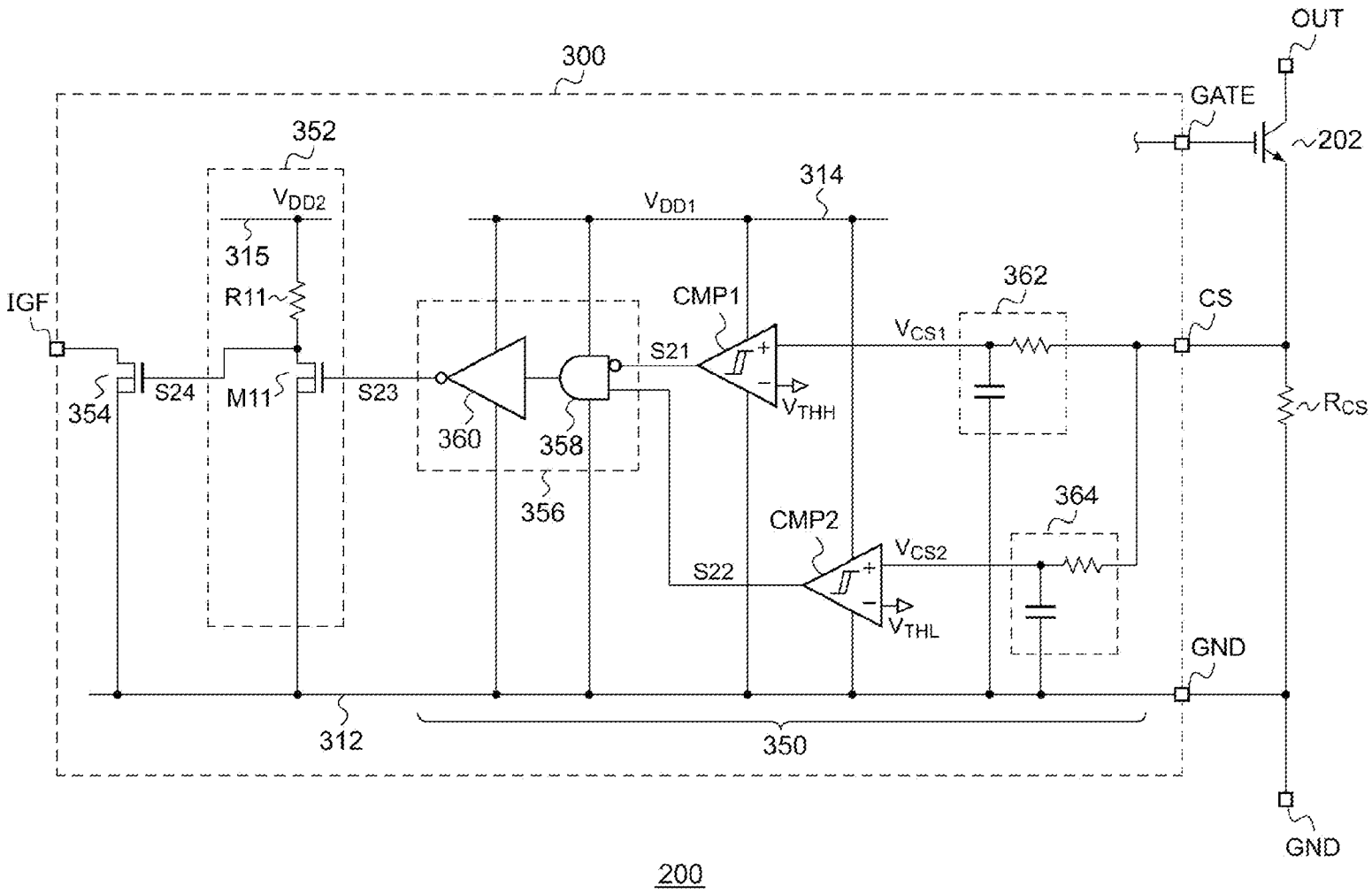
FIG. 7 is a circuit diagram showing a configuration example of an igniter.

FIG. 7 is a circuit diagram showing a configuration example of the igniter 200. As described above, the current comparison circuit 350 compares the coil current $I_C$ with the upper reference current $I_{THH}$ and the lower reference current $I_{THL}$. The feedback signal S23 has (i) the first level (here, high level) when $I_{THL}<I_C<I_{THH}$ and (ii) the second level (here, low level) when $I_C<I_{THL}$ or $I_{THH}<I_C$. The current comparison circuit 350 includes low pass filters 362 and 364, a first comparator CMP1, a second comparator CMP2 and a logic circuit 356.

A detection voltage $V_{CS}$, which is proportional to the coil current IC, is input to the current comparison circuit 350. The detection voltage $V_{CS}$ corresponds to a voltage drop at a current sense resistor $R_{CS}$. The current sense resistor $R_{CS}$ may be a chip part, a resistive component of a bonding wire, or a resistor integrated in an IC of the switch controller 300.

The low pass filters 362 and 364 eliminate noises of the detection voltage $V_{CS}$. The cut-off frequency of each of the low pass filters 362 and 364 is set to be higher than frequency components of a waveform of the detection voltage $V_{CS}$ in the normal operation (tens to hundreds Hz) and lower than a frequency of a noise to be eliminated (1 MHz in radio reception failure BCI). Therefore, the cut-off frequency may be about hundreds Hz to tens Hz. The low pass filters 362 and 364 are not particularly limited in their configurations, but may be simply configured with an RC filter. With the low pass filters 362 and 364, the resistance to noises superimposed on the detection voltage $V_{CS}$ can be increased.

The two comparators CMP1 and CMP2 are associated with the two reference currents $I_{THH}$ and $I_{THL}$, respectively, and receive detection voltages $V_{CS1}$ and $V_{CS2}$ passing though the low pass filters 363 and 364, respectively. The two comparators CMP1 and CMP2 compare the detection voltages $V_{CS1}$ and $V_{CS2}$, which are proportional to the coil current $I_C$, with the two reference voltages $V_{THH}$ and $V_{THL}$ corresponding respectively to the reference currents $I_{THH}$ and $I_{THL}$.

The first comparator CMP1 outputs a comparison signal S21 having a high level when $V_{CS1}>V_{THH}$ and the second comparator CMP2 outputs a comparison signal S22 having a high level when $V_{CS2}>V_{THL}$. Each of the reference voltages $V_{THH}$ and $V_{THL}$ may have its own hysteresis. This can prevent chattering when noise is superimposed on the detection voltage $V_{CS}$ or the reference voltages $V_{THH}$ and $V_{THL}$.

The logic circuit 356 performs a logical operation for the two comparison signals S21 and S22 to generate the feedback signal S23. The logic circuit 356 may be designed in consideration of a combination of high or low levels of the comparison signals S21 and S22 and the feedback signal S23, but is not particularly limited to certain configurations. In this embodiment, the logic circuit 356 includes an AND gate 358 for generating a logical product of the comparison signal S22 and an inversion of the comparison signal S21, and an inverter 360 for inverting an output of the AND gate 358.

The level shifter 352 includes a first resistor R11 and a first transistor M11 connected in series between the ground line 312 and a second power supply line 315 supplied with the second power supply voltage $V_{DD2}$. The feedback signal S23 is input to a gate of the first transistor M11. The level shifter 352 outputs a signal S24 of a node between the first resistor R11 and the first transistor M11.

Figure 8B:
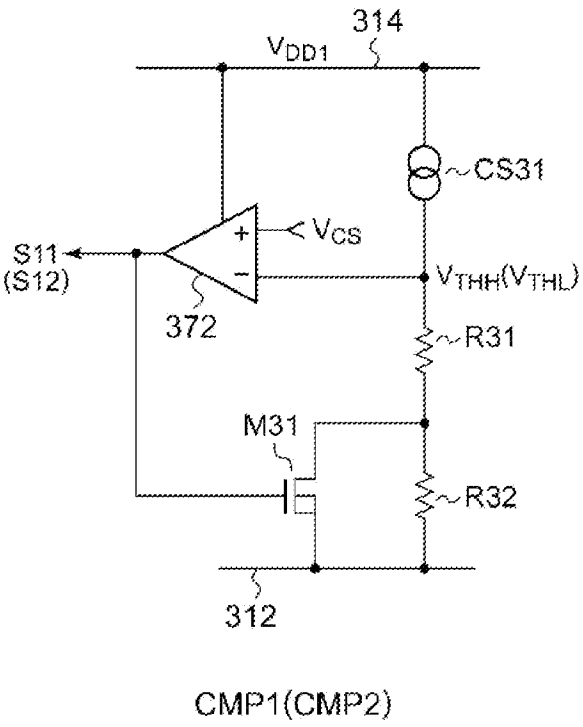
FIGS. 8A and 8B are circuit diagrams showing configuration examples of comparators.
Figure 8A:
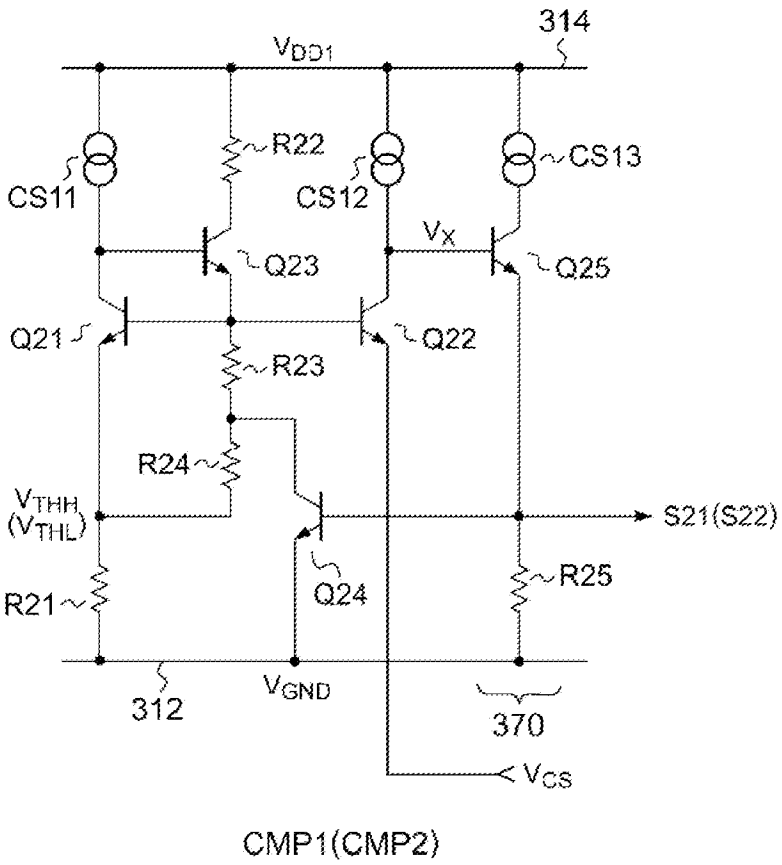

FIGS. 8A and 8B are circuit diagrams of configuration examples of the comparator CMP1 (CMP2). The two comparators CMP1 and CMP2 have the same configuration and will be therefore collectively referred to as CMP. The comparator CMP basically includes a second transistor Q21, a second resistor R21, a third transistor Q22, a first current source CS11, a second current source CS12, a fourth transistor Q23, a third resistor R23, a fourth resistor R24 and a fifth transistor Q24. The second transistor Q21 is an NPN type bipolar transistor. The second resistor R21 is interposed between the ground line 312 and an emitter of the second transistor Q21. The third transistor Q22 has a base connected in common to a base of the second transistor Q21, and an emitter to which the detection voltage $V_{CS}$ is input.

The first current source CS11 is connected to a collector of the second transistor Q21 and the second current source CS2 is connected to a collector of the third transistor Q22. The fourth transistor Q23 has a base connected to the collector of the second transistor Q21, and an emitter connected to the bases of the second transistor Q21 and the third transistor Q22. The third resistor R23 and the fourth resistor R24 are connected in series between the emitter of the second transistor Q21 and the bases of the second and third transistors Q21 and Q22. The fifth transistor Q24 is interposed between the ground line 312 and a node between the third resistor R23 and the fourth resistor R24 and has a base to which the output signal S21 (S22) of the voltage comparator CMP is input.

The basic configuration of the comparator CMP has been described above. An emitter voltage (threshold voltage $V_{TH}$) of the transistor Q21 is compared with an emitter voltage (detection voltage $V_{CS}$) of the transistor Q22 so that a collector voltage Vx of the transistor Q22 is varied based on a result of the comparison. An emitter follower type output stage 370 includes a current source CS13, a transistor Q25 and a resistor R25 and outputs the collector voltage Vx of the transistor Q22 as the comparison signal S21 (S22).

Since the current sense resistor $R_{CS}$ may cause a power loss, its resistance may be required to be desirably as small as possible. On the other hand, since the amplitude of the detection voltage $V_{CS}$ decreases with a decrease in the resistance of the current sense resistor $R_{CS}$, a voltage comparator using an operational amplifier or a differential amplifier may provide less precision in voltage comparison. By using the comparator CMP of FIG. 8A, it can be achieved to compare the detection voltage $V_{CS}$ having a small amplitude with high precision. In addition, with the resistors R23 and R24 and the transistor Q24, it is possible to set a hysteresis in the emitter voltage (i.e., the reference voltage $V_{TH}$) of the transistor Q21.

As shown in FIG. 8B, if the detection voltage $V_{CS}$ is somewhat large, a comparator 372 having a different configuration, which includes an operational amplifier or a differential amplifier, may be used. A reference voltage generation circuit includes a current source CS31 and resistors R31 and R32 that are connected in series between the power supply line 314 and the ground line 312, and a transistor M31 connected in parallel to the resistor R32. A voltage of a node between the current source CS31 and the resistor R31 is output as the reference voltage $V_{TH}$. When the transistor M31 is turned on/off in response to an output of the comparator 372, a hysteresis is set for the reference voltage $V_{TH}$.

To summarize, with the igniter 200 according to the present embodiment, the noise resistance to the IGF signal can be increased according to the following measures against noises.

By increasing the threshold voltage $V_{GS(TH)}$ of the output transistor 354 at the output stage, the noise resistance of the output transistor 354 can be increased. Therefore, it is possible to prevent malfunction that may be caused by (i) variation of the ground voltage $V_{GND}$ of the ground line 312 due to noise, (ii) variation of the gate voltage due to noise input from the IGF terminal via the feedback capacitance Crss of the output transistor 354, and (iii) variation of the voltage $V_{DD2}$ of the second power supply line 315 due to noise.

In addition, by providing the low pass filters 362 and 364, it is possible to increase the resistance to (i) noise introduced in the detection voltage $V_{CS}$ via the OUT terminal and parasitic capacitance of the switch device 202 and (ii) noise introduced in the detection voltage $V_{CS}$ via the ground line 312. Thus, it is possible to prevent a logical level of the feedback signal S23 from being varied due to noise.

In addition, by setting a hysteresis in each of the first and second comparators CMP1 and CMP2, it is possible to prevent chattering. Thus, it is possible to prevent a logical level of the feedback signal S23 from being varied due to noise.

The present disclosure has been described above by way of embodiments. The disclosed embodiments are illustrative only. It should be understood by those skilled in the art that various modifications to combinations of elements or processes may be made and such modifications fall within the scope of the present disclosure. Such modifications will be described below.

Figure 9A:
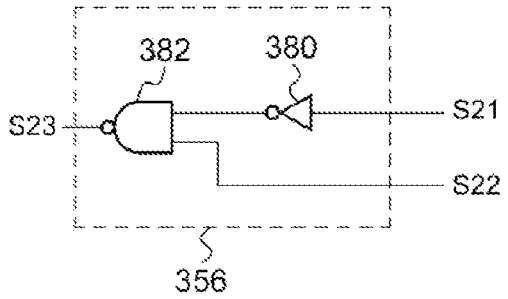
FIGS. 9A to 9C are circuit diagrams of an igniter according to a modified embodiment.
Figure 9B:
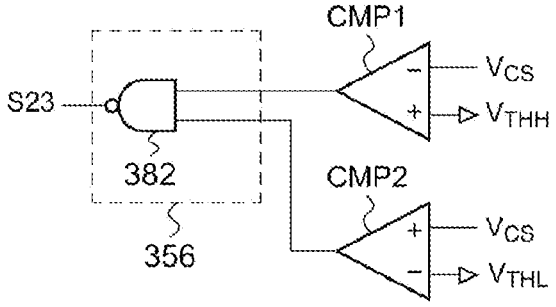
Figure 9C:
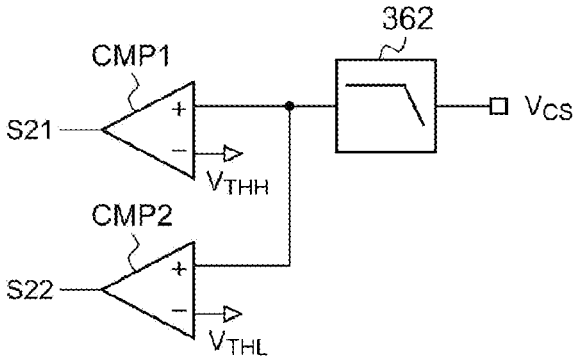

FIGS. 9A to 9C show several modifications, in which the same configurations to the above-explained embodiment are omitted. A logic circuit 356 of FIG. 9A includes an inverter 380 for inverting the comparison signal S21, and an NAND gate 382. In FIG. 9B, instead of using the inverter 380 of FIG. 9A, the polarity of the input of the comparator CMP1 is changed. In FIG. 9C, one low pass filter 362 is provided in common for the two comparators CMP1 and CMP2. It should be understood by those skilled in the art that various other modifications are also possible.

According to the present disclosure in some embodiments, it is possible to increase the resistance of an IGF signal to surges and noises.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. An igniter comprising:

a switch device connected to a primary coil of an ignition coil; and a switch controller configured to control the switch device in response to an ignition signal from an ECU (Engine Control Unit), wherein the switch controller includes:

an input line to which the ignition signal is input;

a determination stage in which a voltage of the input line is compared with a predetermined reference voltage to generate a determination signal based on a result of the comparison;

a drive stage in which ON/OFF of the switch device is controlled in response to the determination signal;

a current comparison circuit, the current comparison circuit receiving a first power supply voltage, comparing a coil current flowing through the switch device with at least one reference current, and generating a feedback signal having a logical level based on a result of the comparison;

an output transistor having one end grounded and the other end connected to a terminal for outputting an ignition check signal, the output transistor having a threshold voltage higher than the first power supply voltage; and a level shifter to receive a second power supply voltage higher than the threshold voltage of the output transistor, to level-shift the feedback signal, and to output the level-shifted feedback signal to a control terminal of the output transistor.

2. The igniter of claim 1, wherein the level shifter includes a first resistor and a first transistor that are connected in series between a ground line and a second power supply line to which the second power supply voltage is supplied.

3. The igniter of claim 1, wherein the current comparison circuit compares the coil current with an upper reference current and a lower reference current, and the feedback signal has (i) a first level when the coil current is smaller than the lower reference current or larger than the upper reference current and (ii) a second level when the coil current is larger than the lower reference current and smaller than the upper reference current.

4. The igniter of claim 1, wherein the current comparison circuit includes at least one voltage comparator which compares a detection voltage proportional to the coil current with at least one reference voltage corresponding to the at least one reference current.

5. The igniter of claim 4, wherein the current comparison circuit includes a filter circuit to eliminate noise of the detection voltage.

6. The igniter of claim 4, wherein the at least one reference voltage has a hysteresis.

7. The igniter of claim 6, wherein the at least one voltage comparator includes:

a second transistor;

a second resistor connected between a ground line and an emitter of the second transistor;

a third transistor having a base connected to a base of the second transistor and an emitter to which the detection voltage is input;

a first current source connected to a collector of the second transistor;

a second current source connected to a collector of the third transistor;

a fourth transistor having a base connected to the collector of the second transistor and an emitter connected to the bases of the second transistor and the third transistor;

a third resistor and a fourth resistor that are connected in series between the emitter of the second transistor and the bases of the second transistor and the third transistor; and a fifth transistor interposed between the ground line and a node between the third resistor and the fourth resistor and having a base to which an output signal of the voltage comparator is input.

8. The igniter of claim 4, further comprising a current sense resistor interposed between the switch device and the ground, wherein a voltage across the current sense resistor is the detection voltage.

9. The igniter of claim 3, wherein the current comparison circuit includes:

a first comparator to compare a detection voltage corresponding to the coil current with an upper reference voltage corresponding to the upper reference current and output a first comparison signal based on a result of the comparison;

a second comparator to compare the detection voltage with a lower reference voltage corresponding to the lower reference current and output a second comparison signal based on a result of the comparison; and a logic circuit to perform a logical operation for the first comparison signal and the second comparison signal to generate the feedback signal.

10. The igniter of claim 1, wherein the switch controller is integrated on a single semiconductor substrate.

11. A vehicle comprising:

a gasoline engine;

an ignition plug;

an ignition coil having a primary coil and a secondary coil connected to the ignition plug;

an ECU to generate an ignition signal indicating ignition of the ignition plug; and an igniter of claim 1, the igniter driving the ignition coil in response to the ignition signal.

* * * * *